US006978718B2

(12) United States Patent
Seyrlehner

(10) Patent No.: US 6,978,718 B2
(45) Date of Patent: Dec. 27, 2005

(54) TAMPING DEVICE AND METHOD OF TAMPING A RAILROAD TRACK'S BALLAST

(76) Inventor: Georg J. Seyrlehner, 12924 Fitzhugh Dr., Newport News, VA (US) 23602

( * ) Notice: Subject to any disclaimer, the term of this patent is extended or adjusted under 35 U.S.C. 154(b) by 19 days.

(21) Appl. No.: 10/793,074

(22) Filed: Mar. 4, 2004

(65) Prior Publication Data

US 2005/0193918 A1 Sep. 8, 2005

(51) Int. Cl.[7] ..... E01B 27/16

(52) U.S. Cl. ..... 104/12; 104/10; 104/2; 104/7.3

(58) Field of Search ..... 104/10, 12, 13, 104/7.3, 8, 7.1, 17.1, 17.2; 404/116, 112, 404/115, 133, 133.1, 133.2, 133.05, 102, 404/103

(56) References Cited

U.S. PATENT DOCUMENTS 2,969,749 A * 1/1961 Flasser et al. ..... 104/12
4,218,978 A * 8/1980 Pasquini ..... 104/12
4,240,352 A * 12/1980 Theurer ..... 104/12
4,445,438 A * 5/1984 Theurer et al. ..... 104/12
4,773,333 A * 9/1988 Theurer ..... 104/12
6,067,910 A * 5/2000 Theurer et al. ..... 104/12
6,386,114 B1 5/2002 Morgan et al. ..... 104/13

* cited by examiner

*Primary Examiner*—Frantz F. Jules

(74) *Attorney, Agent, or Firm*—Peter J. Van Bergen

(57) ABSTRACT

A tamping device and method of compacting ballast beneath the intersection of a railroad track's tie and rail utilize a pair of tamping units, each of which terminates in a tool blade. When a pair of tamping unit's first and second tool blades are in ballast on either side of the track's tie along one side of the rail, the first and second tool blades are moved in respective counter rotational first and second orbital paths such that forces generated in the ballast by the blades cooperate to compact the ballast beneath the intersection of the tie and the rail.

18 Claims, 7 Drawing Sheets

TAMPING DEVICE AND METHOD OF TAMPING A RAILROAD TRACK'S BALLAST

FIELD OF THE INVENTION

The invention relates generally to tamping devices, and more specifically to a tamping device and method of tamping a railroad track's ballast such that the ballast underneath the intersection of a railroad track's tie and rail is compacted.

BACKGROUND OF THE INVENTION

The ballast supporting a railroad track must be compacted from time-to-time to maintain track integrity. Accordingly, a variety of tamping devices have been developed over the years. In general, a tamping device utilizes one or two pairs of tamping units having tool blades that are inserted into the ballast where they are vibrated in some fashion to compact the ballast. Each pair of tamping units has first and second tool blades inserted on either side of a track's railroad tie adjacent the track's rail. Once inserted into the ballast, a vibration mechanism causes the tool blades to vibrate.

Prior art tamping devices fall into two general categories. The first category vibrates the tool blades such that they oscillate perpendicular to the track's tie. The second category oscillates each tool blade through a small angle with respect to a vertical axis of the tool blade's tamping unit. The tamping operation of each category will be explained further below with the aid of FIGS. 1–3.

The above-noted first category of tamping devices will be described with the aid of FIGS. 1 and 2 where a railroad track's tie 10 is shown supporting one of the track's rails 12 with the area beneath and around tie 10 and rail 12 comprising ballast 14 as is well known in the art. In this example, two pairs of tamping units are used with only the tool blades thereof (that interact with ballast 14) being illustrated. Specifically, a first tamping unit pair has tool blades 20 and 22, and a second tamping unit pair has tool blades 30 and 32 positioned/inserted into ballast 14 with tool blades 20/22 positioned on opposing sides of tie 10 along one side of rail 12, and tool blades 30/32 positioned on opposing sides of tie 10 along the other side of rail 12. A motor driven vibration apparatus (not shown for clarity of illustration) is coupled to tool blades 20/22 and 30/32 to vibrate/oscillate the blades back and forth in a direction that is perpendicular to tie 10 as indicated by motion arrows 21, 23, 31 and 33. The vibratory motion can occur in a straight line or single plane fashion, or can occur along pendulum-like arcs (e.g., arcs 21A and 23A for tool blades 20 and 22, respectively) as shown in the side view of FIG. 2. An example of such a tamping device is disclosed by Pasquini in U.S. Pat. No. 4,218,978.

The above-noted second category of tamping devices will be described with the aid of FIG. 3. In this example, each of tool blade pairs 20/22 and 30/32 are again positioned/inserted into ballast 14 as in the previously-described example. The corresponding vertical axis of each tamping unit (not shown) is indicated at 20A, 22A, 30A and 32A, respectively. A motor driven vibration apparatus (once again not shown for clarity of illustration) is coupled to the tool blades to vibrate/oscillate each tool blade through a small angle $\alpha$ (e.g., on the order of approximately 2.5°) about each tamping unit's respective vertical axis as indicated by motion arrows 25, 27, 35 and 37. An example of such a tamping device is disclosed by Morgan et al. in U.S. Pat. No. 6,386,114.

The most critical region in a railroad track's ballast lies beneath the intersection of a tie and rail. However, none of the prior art tamping tools and/or vibration methodologies are very effective at applying compacting forces to the critical tie-rail intersection region of a railroad track's ballast.

SUMMARY OF THE INVENTION

Accordingly, it is an object of the present invention to provide a tamping device for compacting ballast beneath the intersection of a railroad track's tie and rail.

Another object of the present invention is to provide a method of compacting ballast beneath the intersection of a railroad track's tie and rail.

Other objects and advantages of the present invention will become more obvious hereinafter in the specification and drawings.

In accordance with the present invention, a tamping device and method of compacting ballast beneath the intersection of a tie and a rail of a railroad track are provided. At least one pair of tamping units is provided with each pair thereof being defined by a first tamping unit having a first tool blade and a second tamping unit having a second tool blade. For each pair, when the first tool blade and second tool blade are in ballast on either side of the tie along one side of the rail, the first and second tool blades are moved in respective and counter rotational first and second orbital paths. As a result, forces generated in the ballast by the first tool blade and second tool blade cooperate to compact the ballast beneath the intersection of the tie and the rail.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
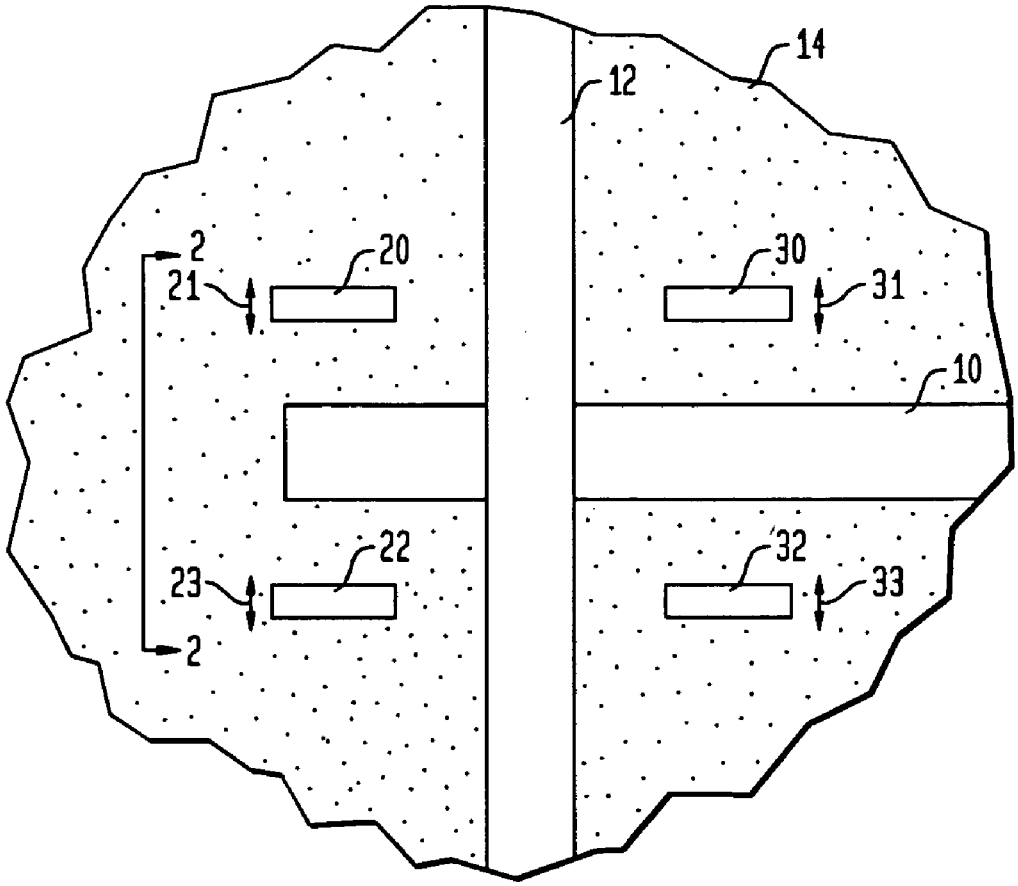
FIG. 1 (PRIOR ART)
FIG. 1 is a schematic top view of a portion of a railroad track illustrating the position and movement of tool blades in a prior art tamping device.
Figure 2:
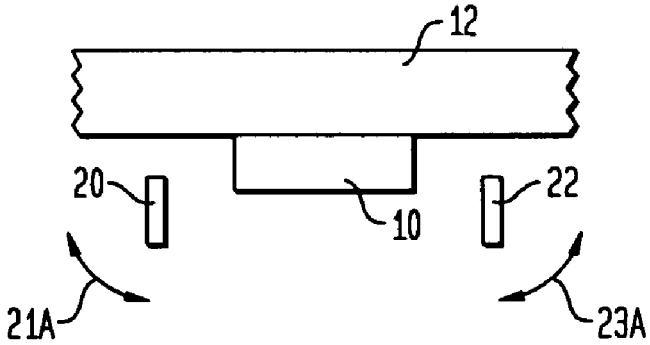
FIG. 2 (PRIOR ART)
FIG. 2 is a side view taken along line 2—2 of FIG. 1.
Figure 3:
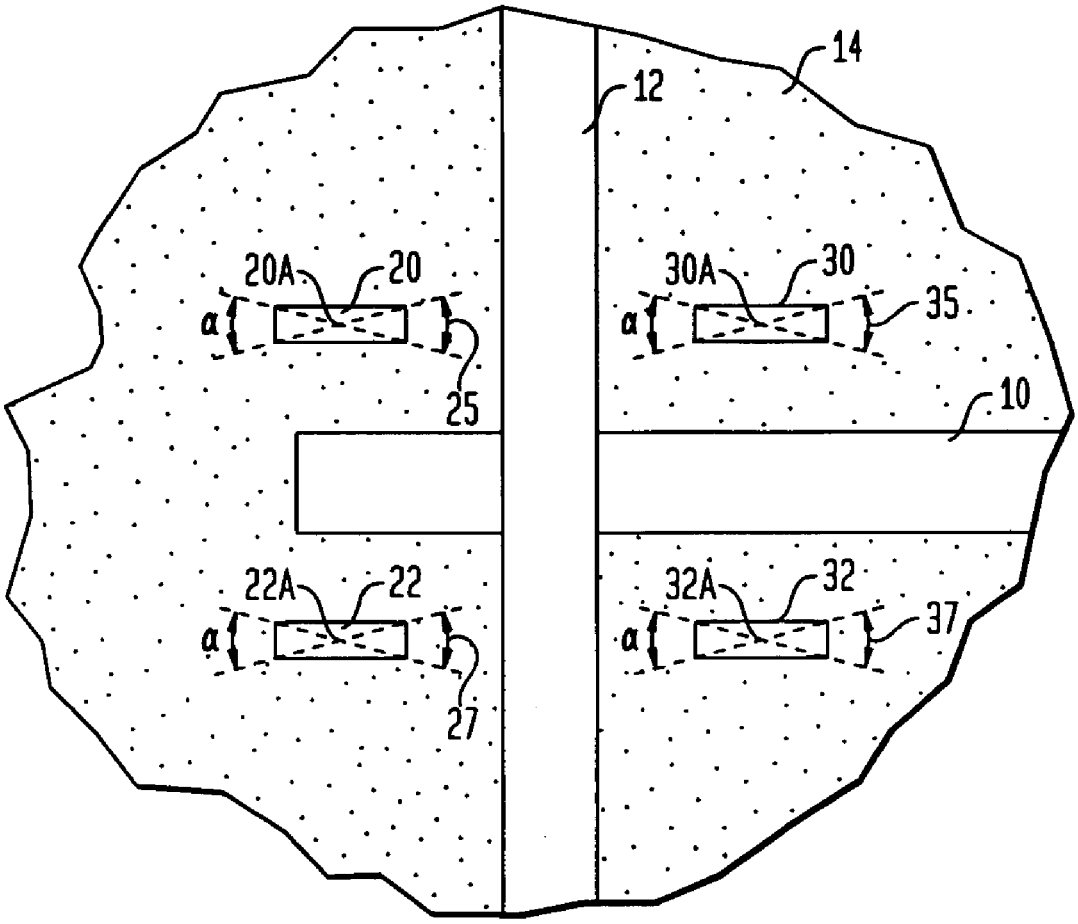
FIG. 3 (PRIOR ART)
FIG. 3 is a schematic top view of a portion of a railroad track illustrating the position and movement of tool blades in another prior art tamping device.
Figure 4:
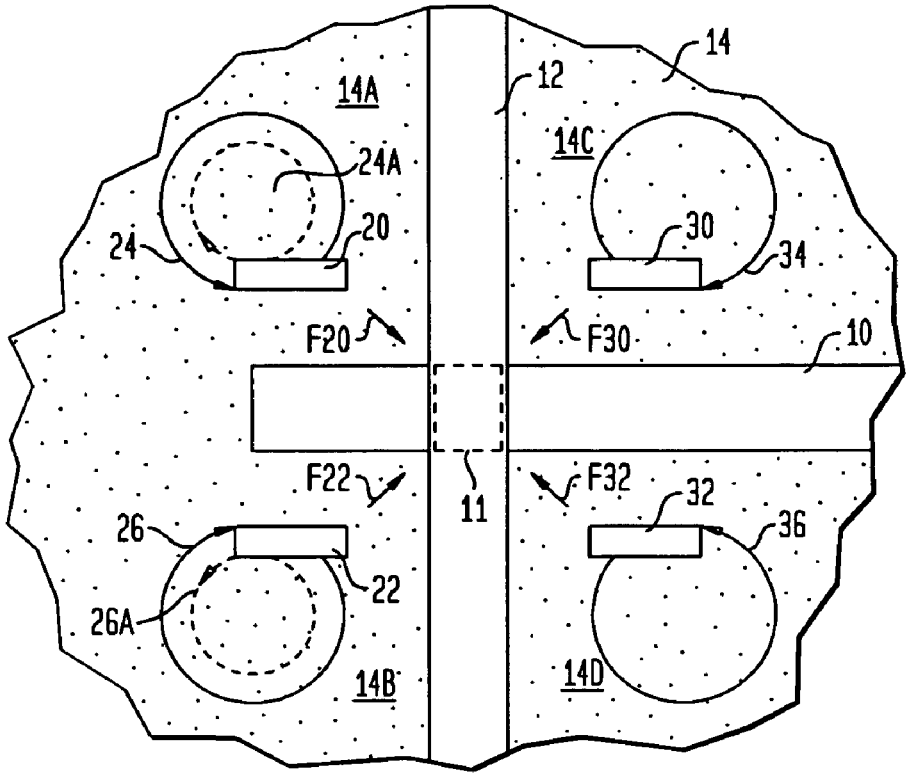
FIG. 4 is a schematic top view of a portion of a railroad track illustrating the position and movement of tool blades in accordance with one embodiment of the present invention.

Referring again to the drawings, and more particularly to FIG. 4, a railroad track's tie 10 is again shown supporting one of the track's rails 12 with ballast 14 residing around and underneath tie 10 and rail 12 as is well known in the art. As mentioned above, the most critical region of ballast 14 for supporting tie 10 and rail 12 is beneath the intersection of tie 10 and rail 12 where such intersection is indicated by the dashed line rectangular region 11. The present invention provides a novel tamping device and method of operating same that directs generated compacting forces towards that portion of ballast 14 that lies beneath intersection 11.

In the embodiment illustrated in FIG. 4, only the tamping device's tool blades are shown for clarity of illustration. Specifically, tool blade pair 20/22 and tool blade pair 30/32 are positioned/inserted into ballast 14. Such tool blade positioning and insertion into ballast 14 are well known in the art and are not limitations of the present invention. Accordingly, the description of the present invention will assume that the tool blades have been properly positioned and inserted into ballast 14. Although not required by the present invention, the tool blades are typically in a constant state of "movement" in order to facilitate tool blade insertion into ballast 14. For example, tool blade movement in the prior art involves some sort of vibration as described above, while tool blade movement in the present invention involves movement in an orbital path as will be described in detail below. It is also to be understood that while a single blade is shown, the present invention could also use multiple blades to carry out the work of each single blade 20, 22, 30 and 32. Accordingly, it is to be understood that use of the singular term "tool blade" can mean single or multiple blades.

Tool blade pair 20/22 is positioned with tool blades 20 and 22 on opposing sides of tie 10 along one side of rail 12, and tool blade pair 30/32 is positioned with tool blades 30 and 32 on opposing sides of tie 10 along the other side of rail 12. Note that in situations where there is not enough room on either side of rail 12 to utilize two pairs of tool blades (e.g., at a railroad track's switch), the present invention can utilize a single tool blade pair (i.e., either tool blade pair 20/22 or tool blade pair 30/32) depending on which side of rail 12 is accessible.

In accordance with the present invention, each tool blade moves in an orbital path that can be circular (as shown), elliptical, oval, etc., without departing from the scope of the present invention. Positions of the tool blades on the orbital paths are controlled so that forces generated in ballast 14 by each tool blade cooperate to compact ballast 14 lying beneath intersection 11. For example, tool blades forming a corresponding pair thereof can be moved in counter rotating orbital paths. In terms of utilizing a single pair of tools as would be the case at a railroad track switch, tool blade 20 is moved in a counter clockwise orbital path 24 while tool blade 22 is moved in a clockwise orbital path 26. (Alternatively, tool blade 20 could be moved along clockwise orbital path 24A while tool blade 22 would be moved along counterclockwise orbital path 26A.)

To optimize the compacting forces (generated by tool blades 20 and 22) acting on ballast 14 beneath intersection 11, it is preferred that both of the following criteria be satisfied. First, orbital paths 24 and 26 should lie in the same (or approximately the same) plane. Second, forces $F_{20}$ and $F_{22}$ (i.e., forces generated by tool blades 20 and 22, respectively, in a region of ballast 14 that represents an orbital path's "closest approach" to intersection 11) should occur simultaneously (or nearly simultaneously) during each orbital path. This can be accomplished by synchronizing movement of tool blade 20 and tool blade 22 in their respective orbital paths 24 and 26 such that they are constantly mirror images (or nearly mirror images) of one another.

The effect of compacting forces $F_{20}$ and $F_{22}$ can be further enhanced by urging or squeezing tool blades 20 and 22 toward one another while moving them along their respective orbital path. Such urging/squeezing forces are indicated by force arrows $F_S$. Application of squeezing force $F_S$ to each of tool blades 20 and 22 increases the component of each force $F_{20}$ and $F_{22}$ (perpendicular tie 10) that compacts ballast 14 under tie 10, while the component of each force $F_{20}$ and $F_{22}$ (parallel to tie 10) acts to compact ballast 14 under rail 12. The combination of forces $F_{20}$ and $F_{22}$ serves to compact ballast 14 under intersection 11.

Figure 5A:
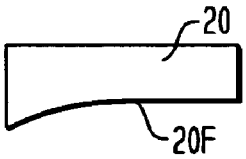
FIG. 5A is an isolated top view of a tool blade having a contoured face.
Figure 5B:
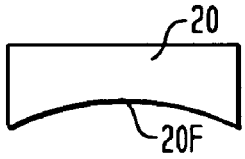
FIG. 5B is an isolated top view of a tool blade having a concave face.
Figure 5C:
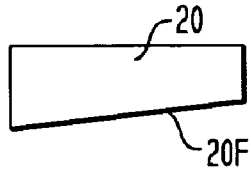
FIG. 5C is an isolated top view of a tool blade having a flat angled face.

The face (e.g., face 20F of tool blade 20) of each tool blade facing tie 10 can be flat as shown in FIG. 4, contoured as shown in FIG. 5A, concave as shown in FIG. 5B, flat and angled as shown in FIG. 5C, or otherwise shaped in a way that appropriately focuses its generated force on ballast 14 in the region of intersection 11. Accordingly, it is to be understood that the particular shape of each tool blade and/or face thereof are not limitations of the present invention.

Since the vast majority of tie-rail intersections define four regions or quadrants of accessible ballast (i.e., quadrants 14A, 14B, 14C and 14D), FIG. 4 shows the positioning of two pairs of tool blades 20/22 and 30/32. With each tool blade pair positioned/inserted into a quadrant of ballast 14 as shown, operation of each tool blade pair 20/22 and 30/32 is the same as described above for the single tool blade pair where forces $F_{30}$ and $F_{32}$ are generated by tool blades 30 and 32, respectively. Furthermore, in order to bring about a simultaneous cooperation of all four compacting forces $F_{20}$, $F_{22}$, $F_{30}$ and $F_{32}$, all orbital paths 24, 26, 34, 36 preferably lie in the same plane with the orbital paths in adjacent quadrants defining counter rotational directions. Thus, in addition to the counter rotation orientation of paths 24/26 and 34/36, adjacent orbital paths 24 and 34 are counter rotational as are adjacent orbital paths 26 and 36.

Figure 6:
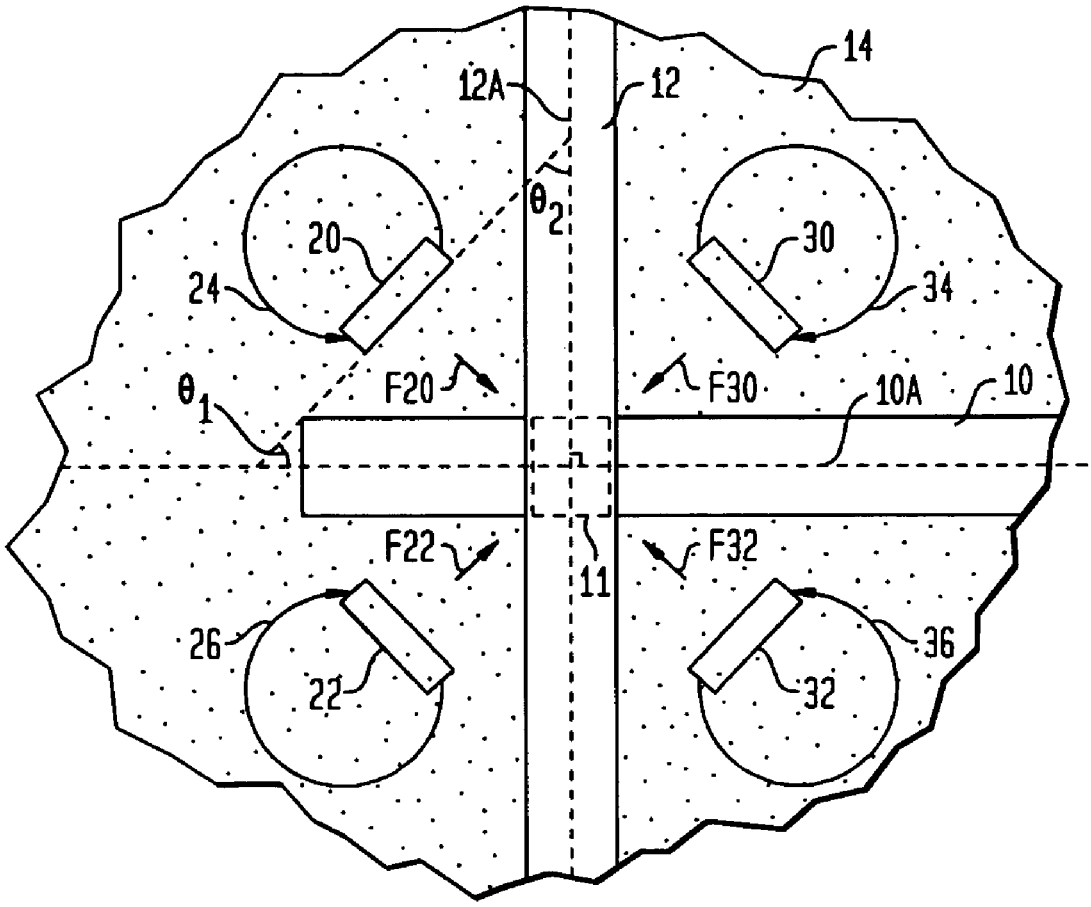
FIG. 6 is a schematic top view of a railroad track illustrating the position and movement of tool blades in accordance with another embodiment of the present invention.

The present invention is not limited to the case where each tool blade directly faces or is squared up with tie 10 throughout its orbital path as is the case with the embodiment illustrated in FIG. 4. For example, each tool blade could be angled towards intersection 11 throughout the tool blade's orbital path as illustrated in FIG. 6. The acute angle $\theta_1$ that a tool blade face makes with the longitudinal axis 10A of tie 10 (or acute angle $\theta_2$ that a tool blade face makes with the longitudinal axis 12A of rail 12) can be adjusted to suit a particular application, orbital path shape, tool blade face specifics, etc., without departing from the scope of the present invention. As with the previous embodiment, each tool blade pair 20/22 and 30/32 can have squeezing force $F_S$ applied thereto while the tool blades move in their respective orbital path.

As will be appreciated by one of ordinary skill in the art, there are many mechanisms that can be used to (i) position the tool blades, (ii) insert the tool blades into ballast near the intersection of a railroad tie and rail, and (iii) move the tool blades in accordance with the teachings of the present invention that have been described above. Indeed, the positioning and insertion of the tool blades falls within the teachings of several prior art tamping devices and, therefore, do not limit the present invention and need not be described further herein. Accordingly, the ensuing discussion will focus on exemplary mechanisms for moving the tool blades in accordance with the present invention.

Figure 7:
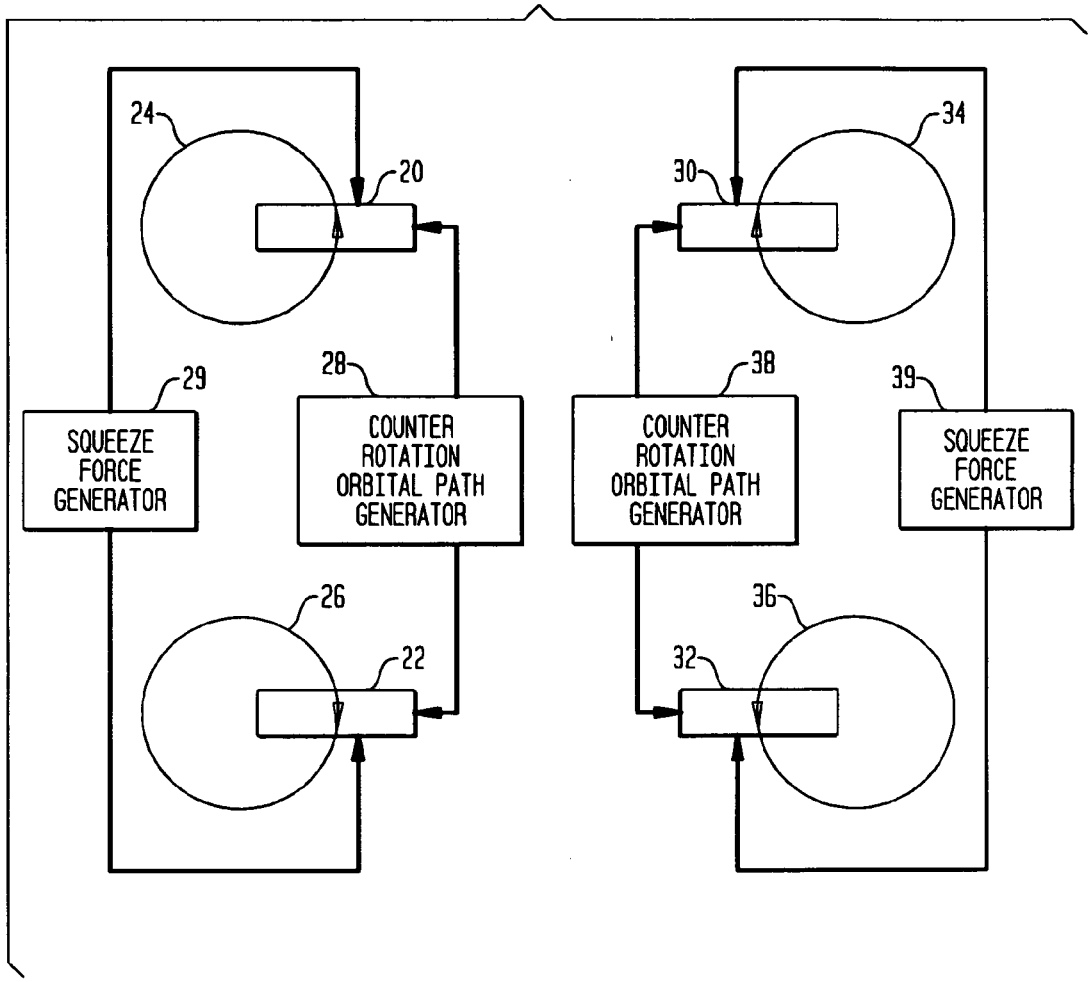
FIG. 7 is a block diagram of the mechanized portion of a tamping device that is to be operated in accordance with the present invention.

Referring now to FIG. 7, a block diagram illustrates generally the mechanism required to carry out the present invention. Coupled to tool blade pair 20/22 is a counter rotation orbital path generator 28 that moves tool blades 20 and 22 on orbital paths 24 and 26, respectively. Although not required, it may be beneficial for generator 28 to utilize a single mechanism to generate coordinated or synchronized orbital path movement such that tool blades 20 and 22 start and remain as mirror images (or nearly mirror images) of one another throughout their orbital path movement. A squeeze force generator 29 is further coupled to tool blades 20 and 22 such that the above-described squeezing force $F_S$ is applied to tool blades 20 and 22 as they move along their orbital paths. Similar mechanisms (i.e., generators 38 and 39) are coupled to tool blades 30 and 32.

Figure 10:
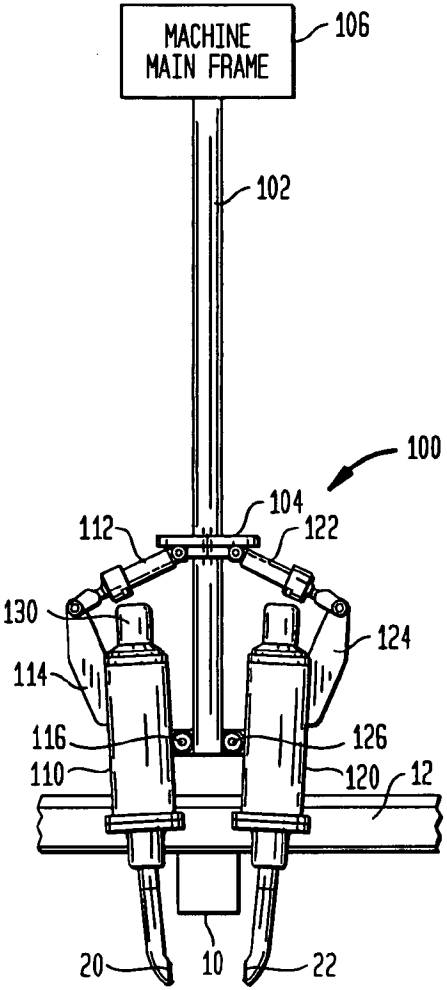
FIG. 10 is a side view of the mechanism of FIG. 8 after the mechanism's tool blades have been squeezed together.
Figure 9:
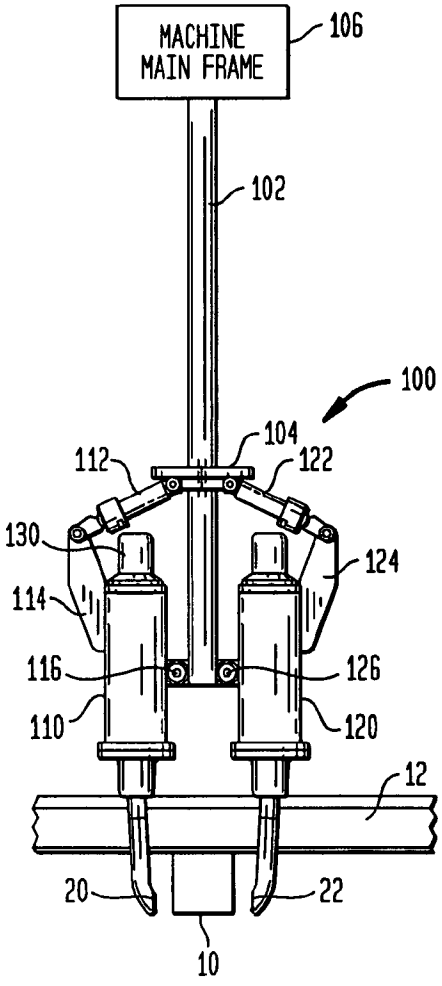
FIG. 9 is a side view of the mechanism of FIG. 8 after insertion of the mechanism's tool blades into the ballast surrounding a railroad tie.
Figure 8:
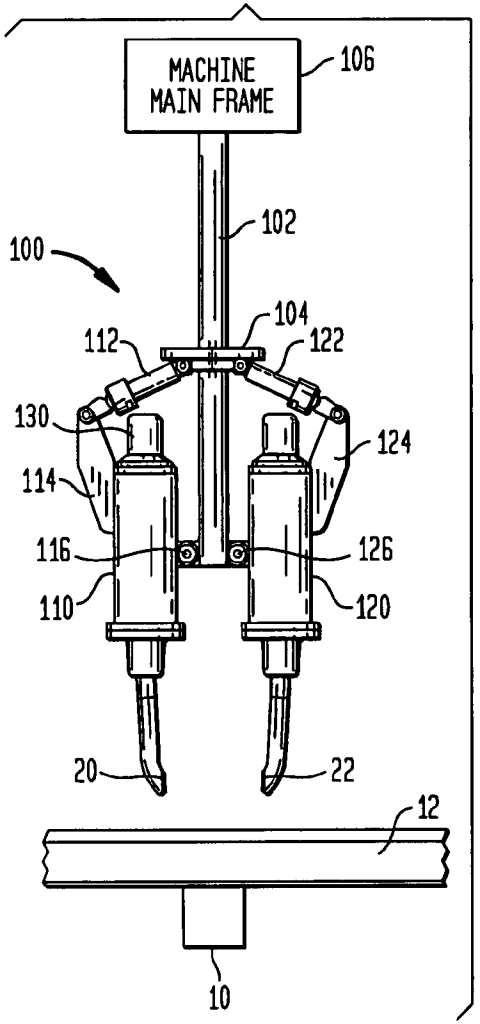
FIG. 8 is a side view of one embodiment of a mechanism that can be used to compact ballast in accordance with the present invention prior to insertion of the mechanism's tool blades into the ballast surrounding a railroad tie.
Figure 11:
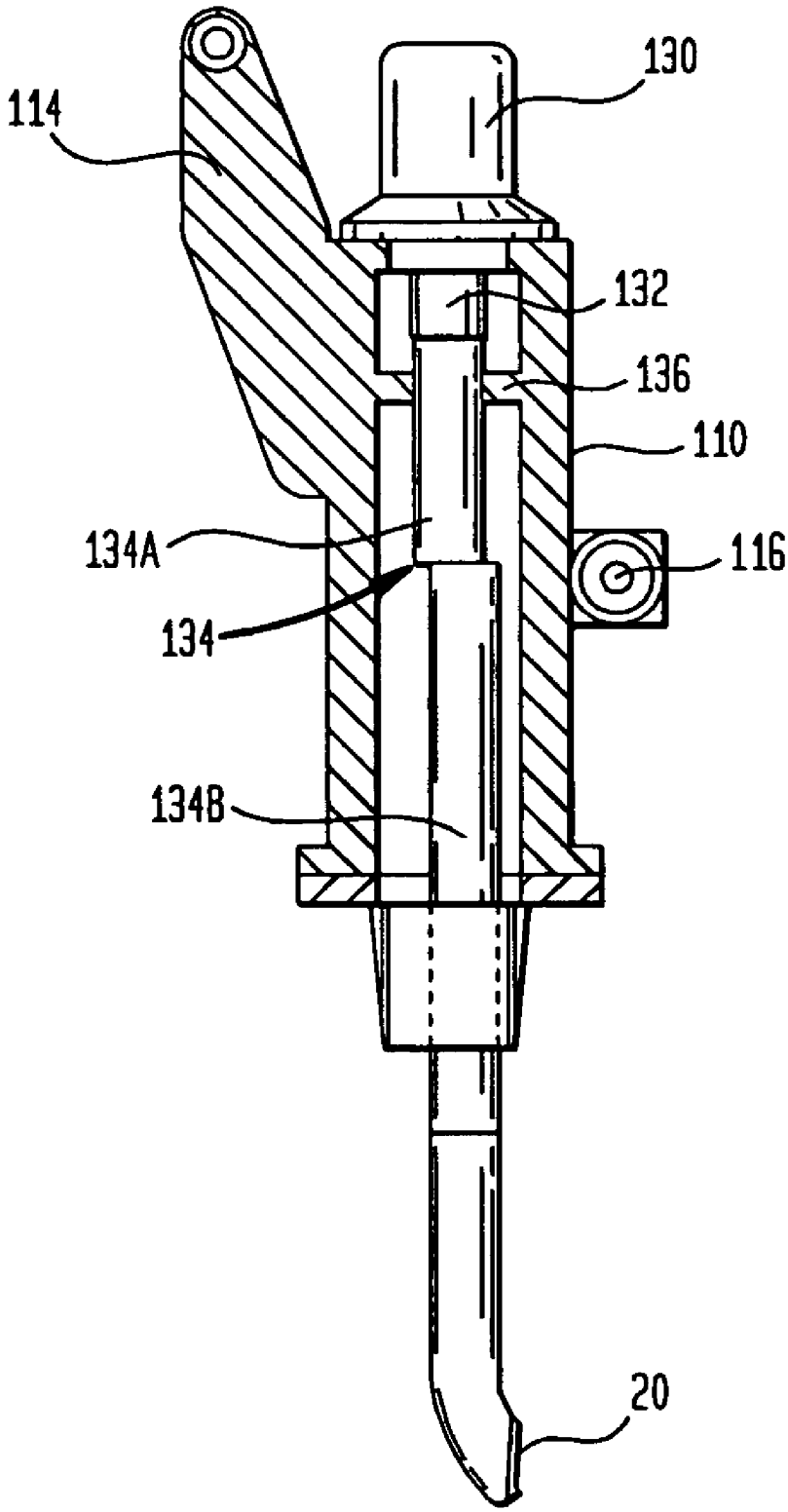
FIG. 11 is a cross-sectional view of a tamping unit that supports a tool blade with the view illustrating a mechanism for imparting an orbital motion to the tamping unit's tool blade in accordance with the present invention.

By way of illustrative example, one mechanism for implementing the present invention will be described with the aid of FIGS. 8–11, where FIGS. 8–10 depict a lowering and squeezing operational sequence for the mechanism and FIG. 11 illustrates a mechanism that can be used to generate the present invention's orbital path motion for the tool blades.

In FIGS. 8–10, a mechanism for lowering (raising) and squeezing of one tool blade pair (e.g., tool blade pair 20/22) is referenced generally by numeral 100. Similar mechanisms would be used for each tool blade pair. Mechanism 100 is coupled to a movable frame 102 by means of a bracket 104. Mechanism 100 is moved up and down by frame 102 which is coupled to and moved by equipment (not shown) on a machine main frame 106. Each of tool blades 20 and 22 is coupled to the lower portion of a tamping unit 110 and 120, respectively. The upper portion of tamping unit 110 is coupled to bracket 104 by means of a hydraulic cylinder 112 and a mounting clevis 114 that is fixed to tamping unit 110. Similarly, the upper portion of tamping unit 120 is coupled to bracket 104 by means of a hydraulic cylinder 122 and a mounting clevis 124 that is fixed to tamping unit 120. The central portion of each tamping unit 110 and 120 is coupled to frame 102 at pivot points 116 and 126, respectively.

In operation, mechanism 100 is positioned over a rail 12 and tie 10 as shown in FIG. 8. As mentioned above, tool blades 20 and 22 will typically be rotating in their counter rotational orbital paths throughout the operation of mechanism 100 in order to facilitate tool blade entry in the ballast. Frame 102 is lowered such that tool blades 20 and 22 are positioned adjacent to and on either side of tie 10 as shown in FIG. 9. Once mechanism 100 is in this position, hydraulic cylinders 112 and 122 are actuated such that tamping units 110 and 120 pivot about points 116 and 126, respectively, and tool blades 20 and 22 are squeezed towards one another as shown in FIG. 10.

With tool blades 20 and 22 positioned as shown in FIG. 10 (or as shown in FIG. 9 if the tool blades are not being squeezed towards one another), movement of tool blades along their counter rotational orbital paths continues as previously described herein. One embodiment of a tamping unit for movement of tool blade 20 in an orbital path is shown in FIG. 11. More specifically, mounted atop tamping unit 110 is a motor 130 capable of generating rotation of a motor shaft 132. Coupled to shaft 132 is an eccentric shaft 134. As would be well understood in the art, upper portion 134A of shaft 134 is supported by a bushing/bearing element 136 and rotates therein with motor shaft 132. Lower portion 134B of shaft 134 is off-center with respect to upper portion 134A such that rotation of upper portion 134A results in an eccentric orbiting movement of lower portion 134B. Tool blade 20 is rigidly coupled to lower portion 134B of shaft 134 so that the eccentric orbiting movement is imparted thereto. Such rigid coupling of tool blade 20 to lower portion 134B can be accomplished by any of a variety of methods that would be well understood in the art. A similar tamping unit could be used to generate the orbital path for tool blade 22. Note that the generation of mirror imaged orbital paths (for a tool blade pair) can be achieved by synchronizing the zero position of the eccentric shafts associated with the tool blade pair.

The advantages of the present invention are numerous. The tamping device and operating methodology apply compacting forces to the most critical region of a railroad track's ballast, i.e. the ballast under the intersection of a track's tie and rail. Thus, the present invention will improve railroad track integrity and safety.

Although the invention has been described relative to a specific embodiment thereof, there are numerous variations and modifications that will be readily apparent to those skilled in the art in light of the above teachings. For example, the tool blades moving in the counter rotational orbital paths in adjacent quadrants (of a railroad track's ballast) need not be mirror images (or nearly mirror images) of one another throughout their orbital paths. That is, the tool blades and/or orbital paths could be shaped in a fashion such that optimum compaction forces are applied to the ballast beneath a tie/rail intersection when the tool blades (in adjacent quadrants of the ballast) are not mirror images of one another throughout their orbital paths. It is therefore to be understood that, within the scope of the appended claims, the invention may be practiced other than as specifically described.

What is claimed as new and desired to be secured by Letters Patent of the United States is:

1. A tamping device for compacting ballast beneath the intersection of a tie and a rail of a railroad track, said tamping device comprising:

at least one pair of tamping units, each said pair of tamping units defined by a first tamping unit having a first tool blade and a second tamping unit having a second tool blade; and said first tamping unit and said second tamping unit each including means for respectively moving said first tool blade and said second tool blade in respective counter rotational first and second orbital paths wherein, when said first tool blade and said second tool blade are in ballast on either side of the tie along one side of the rail that is supported by the tie at the intersection of the tie and the rail, said first tool blade and said second tool blade are angled towards the intersection of the tie and the rail throughout said first orbital path and said second orbital path, respectively, so that forces generated in the ballast by said first tool blade and said second tool blade cooperate to compact the ballast beneath the intersection of the tie and the rail.

2. A tamping device as in claim 1 wherein, at each point in time, said first tool blade moving in said first orbital path is approximately a mirror image of said second tool blade moving in said second orbital path.

3. A tamping device as in claim 1 wherein each or said first orbital path and said second orbital path is circular.

4. A tamping device as in claim 1 wherein said first orbital path and said second orbital lie in a common plane.

5. A tamping device as in claim 1 further comprising means coupled to said first tamping unit and said second tamping unit for urging said first tool blade and said second tool blade towards one another while said first tool blade and said second tool blade are moving in said first and second orbital paths, respectively.

6. A tamping device as in claim 1 wherein said at least one pair of tamping units comprises a first pair of tamping units and a second pair of tamping units, and wherein said first pair of tamping units is positioned on a first side of the rail and said second pair of tamping units is positioned on a second side of the rail.

7. A tamping device for compacting ballast beneath the intersection of a tie and a rail of a railroad track, said tamping device comprising:

four tamping units, each of said tour tamping units terminating in a tool blade; and each of said four tamping units including means for moving its corresponding said tool blade in an orbital path wherein, when each said tool blade is positioned in one of four quadrants of ballast about the intersection of the tie and the rail of the railroad track with each of the four quadrants of ballast being contiguous with ballast beneath the intersection, said orbital paths in adjacent ones of the four quadrants being counter rotating orbital paths such that forces generated in the ballast by said tool blades cooperate to compact the ballast beneath the intersection of the tie and the rail.

8. A tamping device as in claim 7 wherein each said tool blade moving in said orbital path corresponding thereto is closest to the intersection of the tie and the rail at approximately the same time.

9. A tamping device as in claim 7 wherein each said tool blade is angled towards the intersection of the tie and the rail throughout said orbital path corresponding thereto.

10. A tamping device as in claim 7 wherein each said orbital path is circular.

11. A tamping device as in claim 7 wherein each said orbital path lies in a common plane.

12. A tamping device as in claim 7 further comprising means coupled to said four tamping units for urging each said tool blade on one side of the tie towards each said tool blade on an opposing side of the tie.

13. A method of compacting ballast beneath the intersection of a tie and a rail of a railroad track, comprising the steps of:

providing at least one pair of tamping units, each said pair of tamping units defined by a first tamping unit having a first tool blade and a second tamping unit having a second tool blade with said first tool blade and said second tool blade from each said pair of tamping units being located in ballast on either side of the tie along one side of the rail that is supported by the tie at the intersection of the tie and the rail; and moving said first tool blade and said second tool blade in respective and counter rotational first and second orbital paths wherein forces generated in the ballast by said first tool blade and said second tool blade cooperate to compact the ballast beneath the intersection of the tie and the rail.

14. A method according to claim 13 wherein said step of moving comprises the step of coordinating positions of said first tool blade and said second tool blade so that, at each point in time, said first tool blade moving in said first orbital path is approximately a mirror image of said second tool blade moving in said second orbital path.

15. A method according to claim 13 wherein said first tool blade and said second tool blade are angled towards the intersection of the tie and the rail throughout said first orbital path and said second orbital path, respectively.

16. A method according to claim 13 wherein each of said first orbital path and said second orbital path is circular.

17. A method according to claim 13 wherein said first orbital path and said second orbital lie in a common plane.

18. A method according to claim 13 further comprising the step of urging said first tool blade and said second tool blade towards one another while said first tool blade and said second tool blade are moving in said first and second orbital paths, respectively.

* * * * *